US006463705B1

(12) United States Patent
Davis et al.

(10) Patent No.: US 6,463,705 B1
(45) Date of Patent: Oct. 15, 2002

(54) CONTAINER FOR PREFABRICATED TRANSPORTABLE BUILDINGS

(75) Inventors: Don Davis, Mooresville; Mitch Misenheimer, Rockwell; Glenn D. Tucker, Albemarle, all of NC (US); Ronald D. Ward, Harselle, AL (US)

(73) Assignee: Oakwood Homes Corporation, Greensboro, NC (US)

( * ) Notice: Subject to any disclaimer, the term of this patent is extended or adjusted under 35 U.S.C. 154(b) by 0 days.

(21) Appl. No.: 09/442,479

(22) Filed: Nov. 18, 1999

Related U.S. Application Data

(60) Provisional application No. 60/109,268, filed on Nov. 20, 1998.

(51) Int. Cl.[7] ..... E04H 1/00

(52) U.S. Cl. ..... 52/143; 52/79.1; 52/79.9; 52/79.12; 52/745.01; 52/745.02; 52/64

(58) Field of Search ..... 52/79.1, 143, 79.5, 52/79.9, 79.12, 64, 745.01, 234, DIG. 9, 745.02

(56) References Cited

U.S. PATENT DOCUMENTS

| | | | |
|---|---|---|---|
| 649,352 | A | 5/1900 | Rector |
| 968,481 | A | 8/1910 | Kessler |
| 1,054,317 | A | 2/1913 | Sawyer |
| 1,100,273 | A | 6/1914 | Wiard |
| 1,392,110 | A | 9/1921 | Blascheck |
| 1,721,198 | A | 7/1929 | Athey |
| 2,098,469 | A | 11/1937 | Smith |
| 2,142,005 | A | 12/1938 | Roberts |
| 2,259,783 | A | 10/1941 | Sparling |
| 2,485,914 | A | 10/1949 | Owens |
| 2,494,680 | A | 1/1950 | Wiley |
| 2,701,038 | A | 2/1955 | Mooney |
| 2,765,498 | A | 10/1956 | Kelnhofer |
| 2,837,777 | A | 6/1958 | White |
| 2,963,122 | A | 12/1960 | Jagemann |
| 3,095,616 | A | 7/1963 | Bigelow, Jr. |
| 3,097,400 | A | 7/1963 | Davis et al. |
| 3,139,958 | A | 7/1964 | De Witt |
| 3,168,762 | A | 2/1965 | Laidler |
| 3,181,203 | A | 5/1965 | Wenger |
| 3,281,998 | A | 11/1966 | Honold et al. |
| 3,332,178 | A | 7/1967 | Foster |
| 3,338,005 | A | 8/1967 | Gelsavage |
| 3,341,987 | A | 9/1967 | Johansson |
| 3,356,410 | A | 12/1967 | Taylor |
| 3,434,249 | A | 3/1969 | Richey |
| 3,434,253 | A | 3/1969 | Hatcher |
| 3,460,297 | A | 8/1969 | Fritz |
| 3,530,982 | A | 9/1970 | Bigelow, Jr. |
| 3,566,554 | A | 3/1971 | Schaffer et al. |
| 3,591,990 | A | 7/1971 | Bergstedt et al. |
| 3,629,982 | A | 12/1971 | Ballay et al. |
| 3,653,165 | A | 4/1972 | West |
| 3,707,811 | A | 1/1973 | Hampson |
| 3,727,753 | A | 4/1973 | Starr et al. |
| 3,737,191 | A | 6/1973 | Fackre |
| 3,755,976 | A | 9/1973 | Dolhaine |
| 3,792,558 | A | 2/1974 | Berce et al. |
| 3,807,104 | A | 4/1974 | Webster |
| 3,827,198 | A | 8/1974 | Geihl |
| 3,831,337 | A | 8/1974 | Johnson |

(List continued on next page.)

*Primary Examiner*—Carl D. Friedman
*Assistant Examiner*—Jennifer I. Thissell
(74) *Attorney, Agent, or Firm*—Hunton & Williams

(57) ABSTRACT

A container for a prefabricated building is disclosed. The container is formed from components of the prefabricated building. The container is built to substantially conform to standard shipping container sizes. Additional storage for some building components is preferably provided by attaching channel members to the top of the container. Supports and a covering for the additional storage space may be included. The additional storage space is preferably dimensioned to allow the container to substantially conform to standard shipping container sizes.

4 Claims, 6 Drawing Sheets

U.S. PATENT DOCUMENTS 3,832,811 A 9/1974 Briel, Jr.
3,953,947 A 5/1976 Henrich
3,984,948 A 10/1976 Bussard
4,035,964 A 7/1977 Robinson
4,035,965 A 7/1977 Ronai
4,057,284 A 11/1977 Blank
4,067,137 A 1/1978 Korthase
4,070,804 A 1/1978 van der Lely
4,074,474 A 2/1978 Cristy
4,074,475 A 2/1978 Wahlquist
4,075,814 A 2/1978 Theurer et al.
4,112,633 A 9/1978 Mitchell
4,118,901 A 10/1978 Johnson
4,162,595 A 7/1979 Ramos et al.
4,165,117 A 8/1979 Kaiser
4,166,343 A 9/1979 O'Brian et al.
4,327,529 A 5/1982 Bigelow, Jr. et al.
4,545,171 A 10/1985 Colvin
4,603,518 A 8/1986 Fennes
4,635,412 A 1/1987 LePoittevin
4,637,179 A 1/1987 Bigelow, Jr. et al.
4,644,708 A 2/1987 Baudot et al.
4,700,513 A 10/1987 Smith
4,854,094 A 8/1989 Clark
4,891,919 A 1/1990 Palibroda
5,193,325 A 3/1993 Allison
5,201,786 A 4/1993 Larsen
5,257,440 A 11/1993 Bardou et al.
5,279,436 A 1/1994 Elliott et al.
5,317,857 A 6/1994 Allison
5,353,558 A 10/1994 Shea, Sr. et al.
5,403,055 A 4/1995 Allison
5,447,000 A 9/1995 Larsen
5,661,930 A 9/1997 Porter
5,706,614 A 1/1998 Wiley, Jr. et al.
5,706,615 A 1/1998 Bridges et al.

CONTAINER FOR PREFABRICATED TRANSPORTABLE BUILDINGS

This application claims benefit of Prov. No. 60/109,268 filed Nov. 20, 1998.

FIELD OF THE INVENTION

This invention relates to a container for a transportable prefabricated building wherein, the prefabricated building can be assembled using components stored entirely within the container.

BACKGROUND OF THE INVENTION

Prefabricated building containers are generally known. For example, U.S. Pat. Nos. 5,447,000 and 4,891,919 describe existing building containers. As described, such containers are typically of a standard size to facilitate transportation. Preferably, the container has substantially the same size as a "high cube" container (e.g., 8 feet×9½ feet×40 feet).

One drawback of existing container systems is that it is often difficult to fit all of the necessary materials into a single container. For example, additional roofing material, plumbing material or other building material often must be transported or obtained separately from the components within the container.

These and other drawbacks exist.

SUMMARY OF THE INVENTION

An object of the invention is to overcome these and other drawbacks in existing devices.

Another object is to provide a transportable building container having a standard shipping size and further comprising a storage area for additional building material.

Another object is to provide a building container corner casting which enables a container to be easily transported with conventional shipping equipment and creates a framework for an additional storage compartment.

Another object is to provide a method of creating a building container using substantially just the components of the ultimate building structure.

Another object is to provide a method of creating a building from substantially the exclusive contents of the building container.

These and other objects are accomplished by providing a container for a prefabricated building structure comprising an outer perimeter box-like frame comprised of multiple tubing elements; substantially continuous panels, attached to the frame, forming side walls of said container; castings attached to comers of said frame; and channel members attached to a top portion of said frame for forming a storage compartment.

DETAILED DESCRIPTION OF THE PREFERRED EMBODIMENTS

Figure 1:
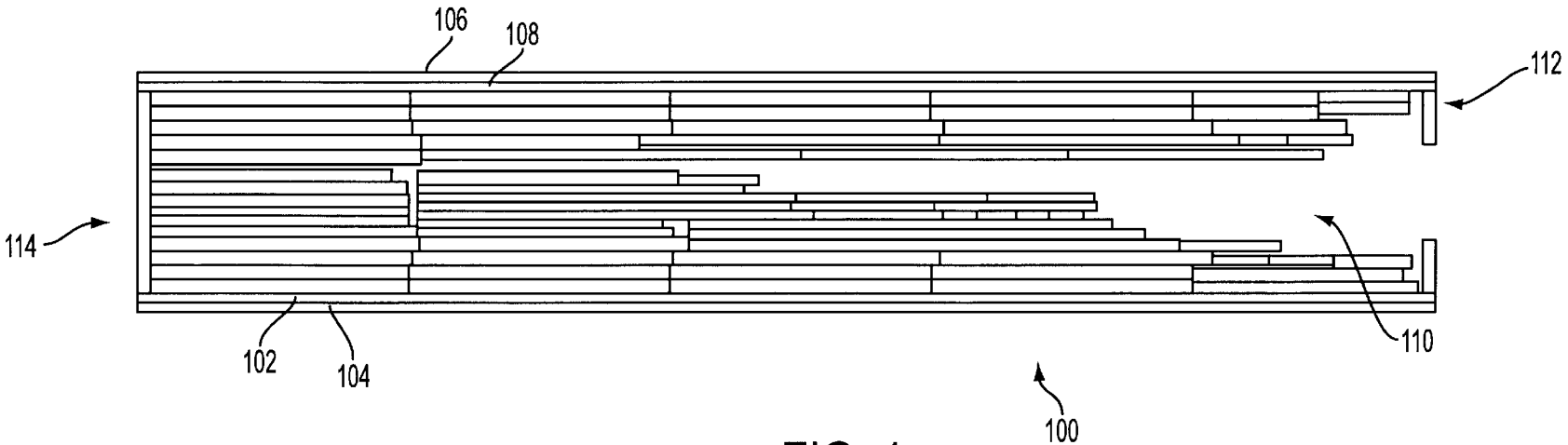
FIG. 1 shows a top view of one embodiment of the building container.

The present invention comprises a self-enclosed rectangular shipping container 100 which contains all of the components necessary to build a two-story single family detached home or a two-story duplex. The shipping container 100 has a galvanized metal covering (e.g., 150) on the exterior thereof. The container 100 is formed from two longitudinal side walls 104, 106, two end walls 114, 112 and a top and a bottom. Each of the longitudinal side walls 104, 106, the top section and the bottom section is rectangular, having a lengthwise dimension of either twenty feet or forty feet. Each of the top, bottom, longitudinal side walls 104, 106 and end walls 112, 114 has an outer perimeter formed by hollow square metal tubing approximately three inches in width. Alternatively, the perimeter may be formed using other types of metal framing (e.g., I or L-shaped profiles, widths different than three inches, or other variations). The container has six sides, with each side having four square metal tubes (e.g., 120, 122, 124, 126) on the outer periphery. The perimeter of the container is thus defined by twenty-four elongate square tubes.

The longitudinal side walls 104, 106 and the top and bottom sections each have a plurality of I-beams, square metal tubing, or L-shaped beams, extending between the perimeter tubing at predetermined intervals. Plywood sections are placed on and secured to the I-beams, square metal tubing, or L-shaped beams.

Comer castings (or corner fittings) 130, 132, 134, 136 are attached to the eight respective corners of the container. Each of the corner castings may include apertures for lifting and securing the container to a trailer, a ship deck, or to other stacked containers. Each corner casting may be indirectly secured (using bolts) to the container 100, for example, through a pair of gusset plates.

The gusset plates may be half-inch steel plates welded to the corner castings 130, 132, 134, 136. The gusset plates form a 90° angle with respect to one another and are provided with holes which correspond with holes provided in the three inch square tubing at the corners of the container 100. Specifically, each of the upper corner castings 130, 132 has gusset plates with upper holes.

One of the upper holes on the gusset plates corresponds with a hole formed on the top wall of the container 100. The other upper hole is on the other gusset plate and corresponds with a hole formed on the end periphery of the top wall of the container 100. One of the gusset plates also includes a lower hole which is adapted to be secured to the vertical square tubing of the longitudinal side wall 104, 106 at the end of the container 100. Once the corner castings 130, 132, 134, 135 are removed from the eight corners of the container 100, the container 100 is still an enclosed structure. A plurality of bolts secure the longitudinal end walls to the top and bottom floor sections even when the corner castings are removed.

The sewer and water lines of the container are preferably installed in the building when it is on site, but, if desired, the electrical lines may be substantially pre-installed in the wall sections.

After the container 100 is filled with the contents forming the prefabricated building, the longitudinal side walls are rigidly fastened to the top and bottom sections by a plurality of bolts extending through the square tubing.

When the container 100 reaches its destination, the container 100 is placed on a foundation which is built on site. The foundation may comprise various types of building foundations known in the art, for example, poured concrete, block and pier, metal frame, etc. For embodiments comprising a metal frame foundation, the metal frame foundation may include a plurality of square tubes placed in concrete footers. The square tubing on the bottom of the container 100 is welded to the metal frame foundation. In alternative designs, the permanent foundation may be formed from concrete with bolts extending upwardly from the concrete. The bottom of the container 100 in this instance would be provided with a plurality of holes for accepting the upwardly extending bolts. In any case, after securing the container to the foundation, the comer castings 130, 132, 134, 136 are then removed, and the bolts securing the longitudinal side walls to the top and bottom sections are removed next. The longitudinal side walls 104, 106 are then opened, removed to a location on the site remote from the container, and, at an appropriate later time, placed horizontally on the foundation. These longitudinal side walls are preferably welded at two edges of the bottom section to form the lower floor of the home. Inside the container 100 immediately adjacent the two respective longitudinal side walls 104, 106 are two vertically positioned walls ("inner walls") 102, 108 having substantially the same length as the longitudinal side walls 104, 106. These inner walls 102, 108 are positioned on respective sides of the top section of the container 100 and, together with the top section of the container 100, eventually form the upper floor of the home. The exterior walls of the building are then removed from the container and, after the lower floor of the home is constructed, the exterior walls are placed around the perimeter of the lower floor and eventually support the upper floor section of the container.

One embodiment of the building container 100 is shown in FIG. 1, which represents a top view of the container as it appears when partially filled with building components. Only one arrangement for packing building components is depicted; other arrangements are possible and can be designed to accommodate desired building components. Preferably, the components necessary to complete an entire building can be packaged into the container 100. For example, prefabricated flooring members, walls, windows, roofing struts, and other materials, are preferably packaged to create container 100. As shown in FIG. 1, the container 100 substantially approximates the dimensions of a standard container (e.g., 8 feet×8 feet×40 feet) or a high cube container (e.g., 8 feet×9 ½feet×40 feet) either of which can be shipped via truck, rail, sea going vessel, or other known manner.

In one embodiment, the container includes "long" walls (or "longitudinal side walls or "elements") 104 and 106. Inner walls 102 and 108 are placed inside the container 100 behind the longitudinal side walls 104 and 106. Preferably, each of the elements 102, 104, 106, and 108 comprises substantially continuous building components (or single solid panels) and span the length of the container 100. For example, elements 102, 104, 106 and 108 may comprise walls constructed of typical building materials (e.g, framing studs, insulation, drywall, etc.). Other building components may preferably be packaged in the space formed in between elements 104 and 108. For example, other pre-framed wall panels, windows, doors, and other building components may be packaged, substantially parallel to each other, in the space between elements 104 and 108. In some embodiments, the pre-framed wall panels, doors, windows and other substantially flat building components are preferably packaged in such a manner to leave an empty space 110 in the front portion 112 of the container 100. Space 100 may preferably be filled by packing into it other building components. For example, plumbing fixtures, appliances, furniture, and other items may be packaged into space 110.

Figure 2:
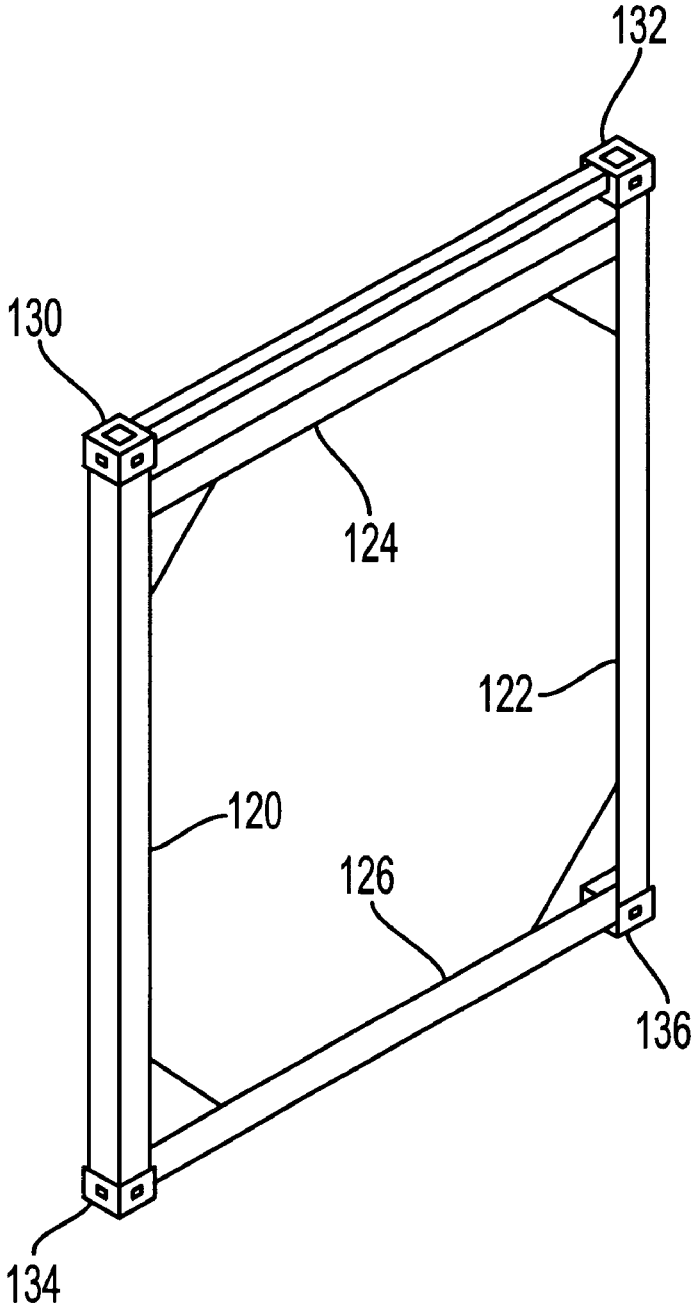
FIG. 2 shows a perspective view of one embodiment of framing members for the building container.

Front portion 112 and rear portion 114 of the container 100 preferably comprise substantially rigid frame members to augment structural integrity and o facilitate transportation of the container 100. FIG. 2 shows one embodiment of the invention comprising steel frame members 120, 122, 124 and 126. Frame members 120, 122, 124 and 126 preferably comprise substantially beam-like (or beam shaped) members with a substantially L-shaped cross-section which enable container 100 to retain a substantially rectangular box shape. Other cross-section shapes are possible. Frame members 120, 122, 124 and 126 preferably comprise a system for attaching the frame members to the container 100. For example, the frame members 120, 122, 124 and 126 may contain holes, suitable for attaching bolts, screws, nails or other fasteners.

Preferably, the container 100 comprises receptacles suitable for interfacing with typical transportation equipment. For example, steel castings 130, 132, 134 and 136 may be attached to frame members 120, 122, 124 and 126. Castings 130, 132, 134 and 136 may be attached to the frame members 120, 122, 124 and 126 in any suitable fashion. For example, the castings 130, 132, 134 and 136 may be welded, bolted, screwed or attached to the frame members with a suitable attachment method. Alternatively, some of the frame members 120, 122, 124 and 126 may be integrally formed with castings attached. The castings 130, 132, 134 and 136 preferably comprise slots, holes or impressions which are capable of interfacing with typical transportation equipment. For example, castings 130, 132, 134 and 136 may comprise slots which shipping crane hooks or fork lift blades fit through to enable the lifting of container 100. Alternatively, castings 130, 132, 134 and 136 may comprise protrusions or bars which enable interfacing with typical transportation equipment. Preferably, castings 130, 132, 134 and 136 are also capable of mating with one another to enable "stacking" of several containers 100.

Figure 3:
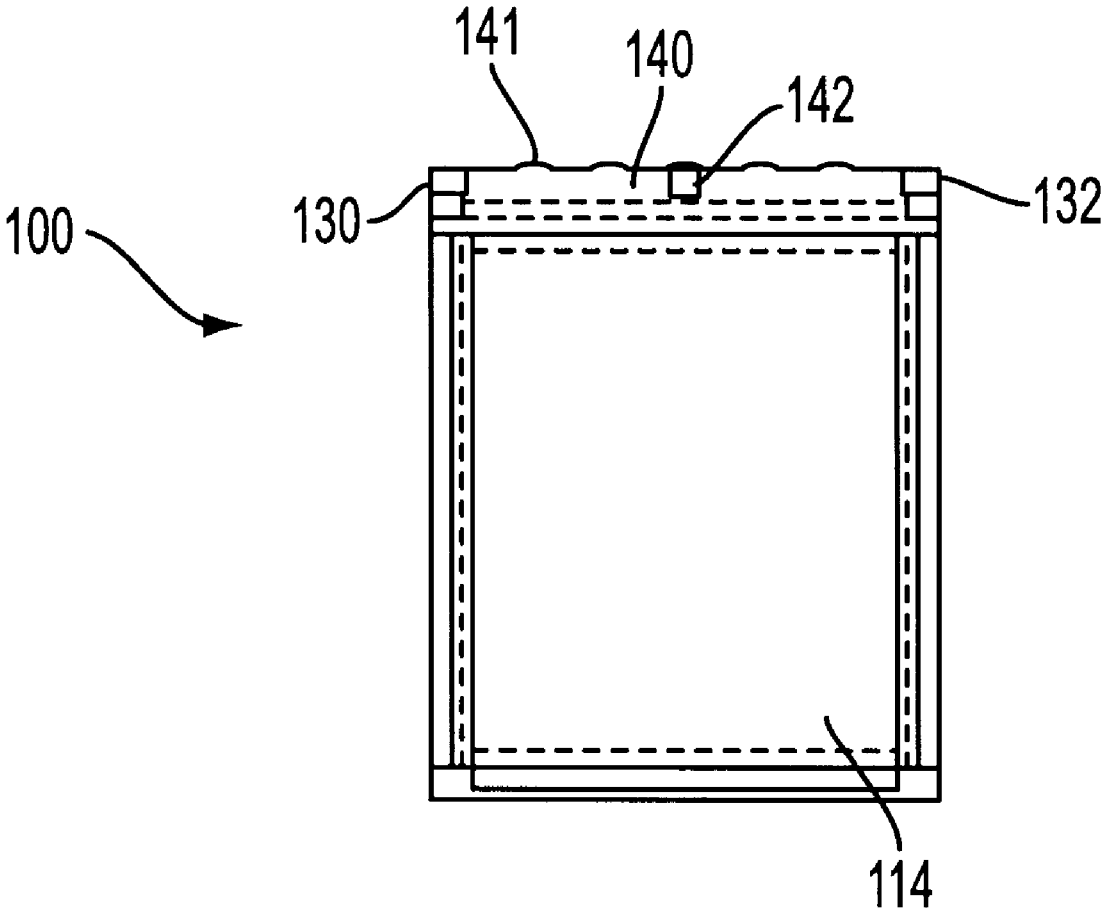
FIG. 3 shows one embodiment of the building container including an additional storage compartment.

Castings 130, 132, 134 and 136 preferably enable another aspect of the present invention by allowing the creation of an additional storage compartment which, when placed on top of a standard container (e.g., 8 foot×8 foot×40 foot) converts the standard container to a high cube container (e.g., 8 foot×9½ foot×40 foot). Alternatively, an additional storage compartment can be created on top of a non-standard size container to convert the container into a standard size container (e.g., 8 foot×8 foot×40 foot). FIG. 3 shows one embodiment of container 100 including an additional storage compartment 140 formed in cooperation with casting members 130 and 132. Preferably, castings 130 and 132 are dimensioned in such a manner that the overall size of container 100 does not exceed a standard shipping container size (e.g., a high C cube or super high cube).

Figure 5A:
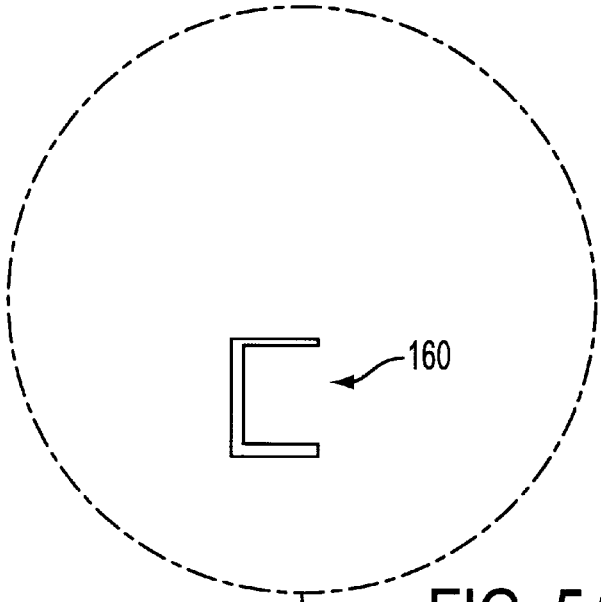
FIG. 5A shows a side exploded view of another component of one embodiment of the invention.
Figure 5:
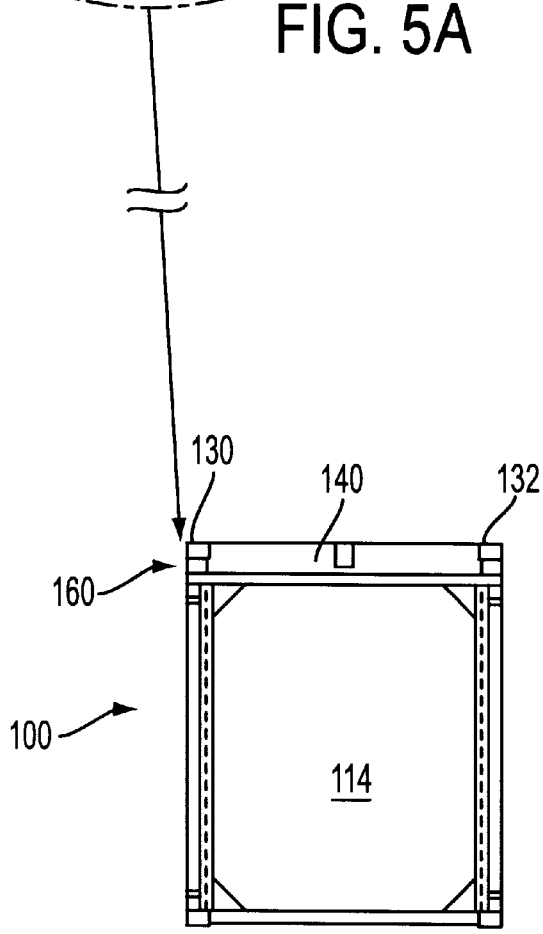
FIG. 5 shows a front and exploded view of another component of one embodiment of the invention.

FIG. 5 shows a front view of another component of one embodiment of the invention. Storage compartment 140 may preferably be formed with the cooperation of channel members 160. Channel members 160 are preferably shaped and attached to the container 100 so as to form a compartment 140. For example, channel members 160 may comprise substantially straight members having a substantially square C-shaped, L-shaped, Z-shaped, I-shaped, or other cross section (one example of which is depicted in FIG. 5A, which is an exploded and side view of the channel member 160). Channel members may be attached to the container 100 in a suitable manner. For example, channel members 160 may be secured with bolts, screws, or power driven fasteners. Other attachment methods are possible such as powder fired fasteners or welding.

As shown in FIG. 3, the additional storage compartment 140 may preferably be formed in the area above the top of container 100. In some embodiments, additional panels 141 may be used to form a cover for the additional storage compartment 140. Panels 141 may comprise wood, plywood, lumber, composite panels, particleboard, sheet metal, or other rigid building material. In some embodiments it may be preferable to include support members for panels 141. For example, a center support 142 may be provided. Support 142 may preferably comprise additional useable building materials. For 30 example, support 142 may comprise a 2×8 pieces of lumber.

Figure 4:
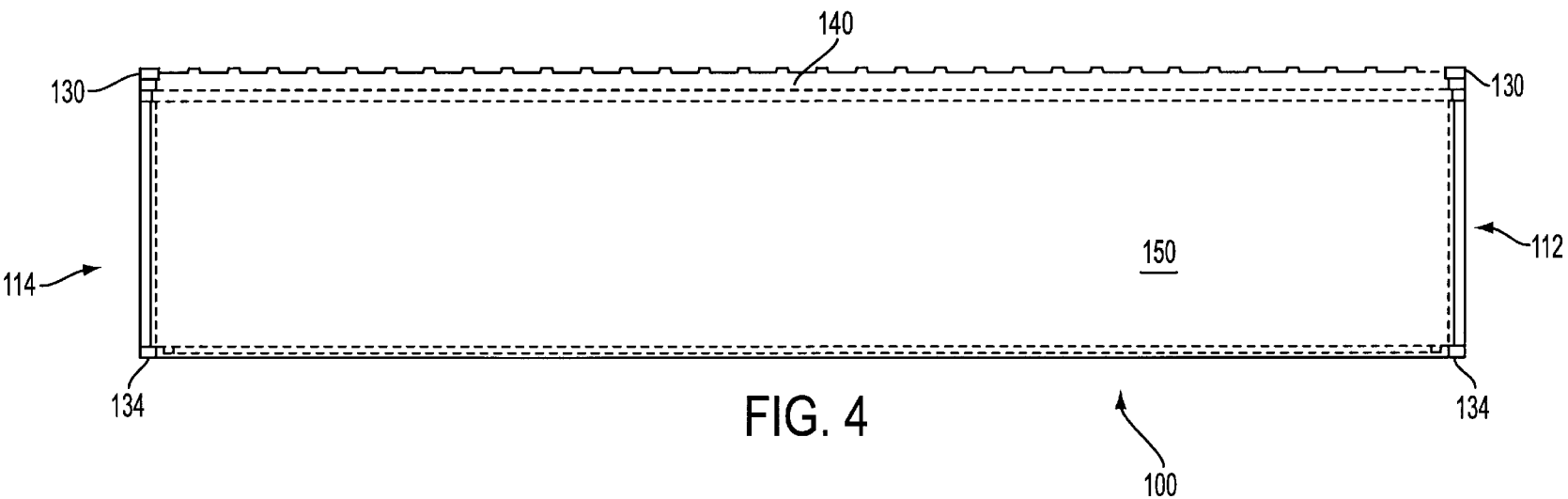
FIG. 4 shows one embodiment of the building container illustrating a side view of the present invention.

FIG. 4 shows one embodiment of the container 100 illustrating a side view of the present invention. As shown, storage compartment 140 may span the length of container 100. Preferably, storage compartment 140 may be packed with additional building material to complete the prefabricated building. For example, asphalt roofing shingles, fiberglass insulation, floor coverings and other materials may be packed into the storage compartment 140.

For some embodiments of container 100 it may be preferable to protect the container from adverse weather and environmental conditions. For example, in situations where the container is shipped aboard a sea going vessel it may be preferable to protect the container from the salty water and air. One embodiment of the invention provides for the attachment of a protective covering 150 over container 100. Protective covering (or "covering") 150 is preferably chosen to protect against potential hazards incurred when transporting container 100. For example, the protective covering 150 may comprise 30 gauge sheet metal fastened to the top, bottom and sides of container 100. Covering 150 may be attached in a manner suitable for the chosen covering. For example, a sheet metal covering 150 may be attached using low velocity powder fired pins and washers or other appropriate fasteners such as screws.

Figure 6:
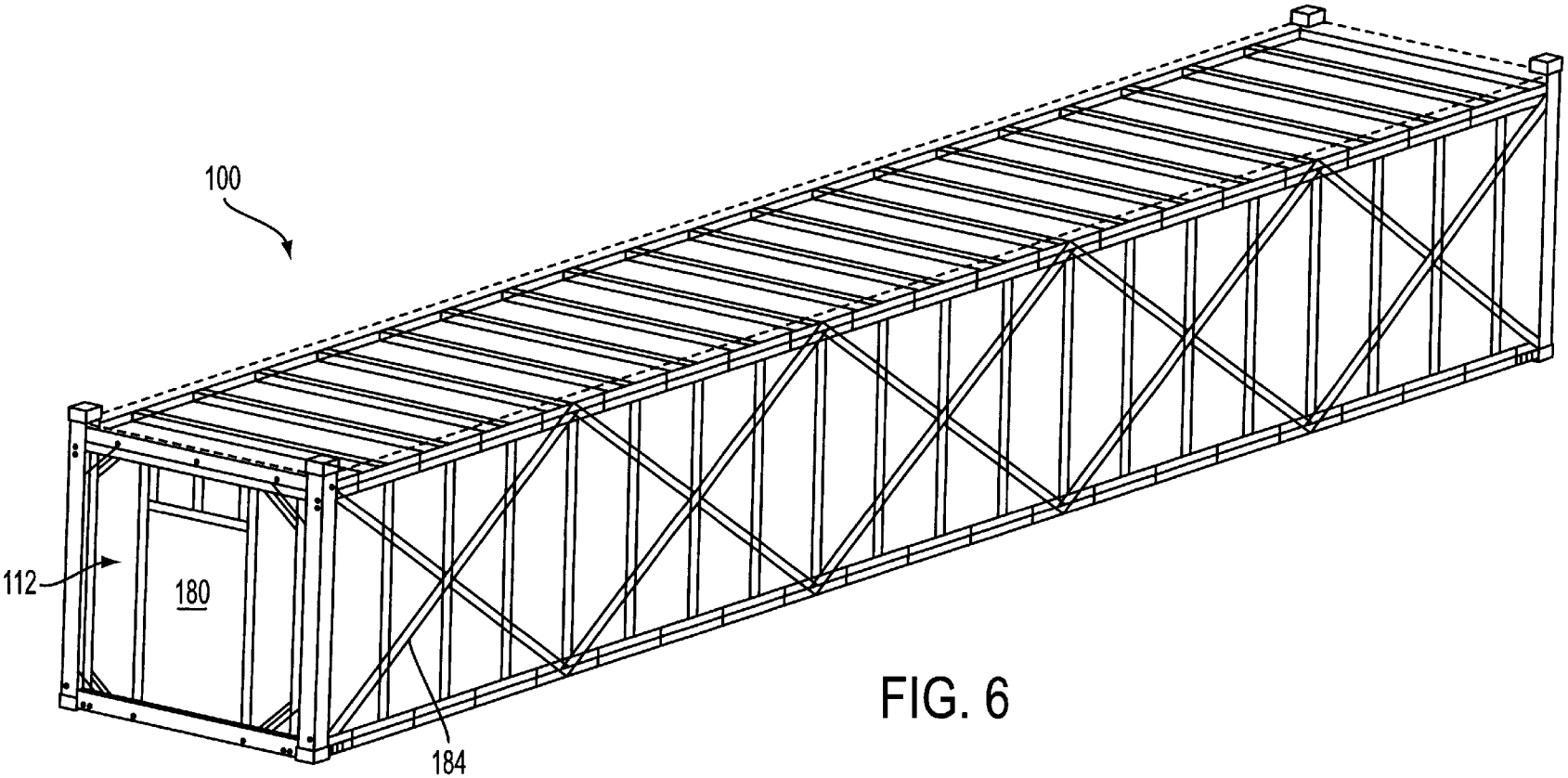
FIG. 6 shows a perspective view of one embodiment of the invention.

FIG. 6 shows a perspective view of one embodiment of the invention. As shown, container 100 may comprise additional structural support members 184 to increase structural integrity. Support members 184 may comprise any suitable material and preferably can be used in assembling the prefabricated building. For example, supports 184 may comprise flat pieces of steel, or lumber, which can be used to assemble or support structures in the prefabricated building. Also shown in FIG. 6 is a front portion 112. As shown, front portion 112 may comprise an aperture 180 through which entry and exit into container 100 may be obtained. Preferably, aperture 180 may comprise a door for the prefabricated structure when completed (e.g., a front entrance door or the like).

Other embodiments and uses of the invention will be apparent to those skilled in the art from consideration of the specification and practice of the invention disclosed herein. The specification and examples should be considered exemplary only. The scope of the invention is only limited by the claims appended hereto.

What is claimed is:

1. A container for a prefabricated building structure comprising:

an outer perimeter box-like frame comprised of multiple tubing elements;

substantially continuous panels, attached to the frame, forming side walls of said container;

castings attached to comers of said frame; and channel members attached to a top portion of said frame for forming a storage compartment.

2. A container of claim 1, wherein the dimensions of the container, including the storage compartment, do not exceed the dimensions of the high C cube or super high C cube.

3. A method of forming a container for a prefabricated building comprising:

forming an outer perimeter box-like frame from multiple tubing elements;

assembling prefabricated building components into a substantially rectangular configuration and placing them in the frame;

attaching substantially continuous panels to the frame to form the walls of said container;

attaching castings to comers of said frame;

attaching channel members to at least a top side of said frame;

forming a storage space in between said channel members wherein building components may be packed.

4. A method of transporting structural components of a prefabricated building structure in a container comprised of:

a) an outer perimeter, box-like frame, which includes multiple tubing elements;

b) substantially continuous panels, attached to the frame, forming side walls of the container;

c) castings attached to comers of the frame; and d) channel members attached to a top portion of the frame for forming a storage compartment;

the method comprising:

i) packing the structural components into the box-like frame and into the storage compartment; and ii) transporting the container to its destination.

* * * * *